US011733642B2

(12) United States Patent
Harada

(10) Patent No.: US 11,733,642 B2
(45) Date of Patent: Aug. 22, 2023

(54) IMAGE FORMING APPARATUS AND ADJUSTMENT METHOD

(71) Applicant: KYOCERA Document Solutions Inc., Osaka (JP)

(72) Inventor: Yuzo Harada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/816,952

(22) Filed: Aug. 2, 2022

(65) Prior Publication Data

US 2023/0040944 A1 Feb. 9, 2023

(30) Foreign Application Priority Data

Aug. 4, 2021 (JP) ..... 2021-128336

(51) Int. Cl.
*G03G 21/16* (2006.01)
*G03G 21/18* (2006.01)

(52) U.S. Cl.
CPC ..... *G03G 21/1647* (2013.01); *G03G 21/1671* (2013.01); *G03G 21/1676* (2013.01); *G03G 21/1821* (2013.01)

(58) Field of Classification Search
CPC ..... G03G 21/1647; G03G 21/1671; G03G 21/1676; G03G 21/1817; G03G 21/1821
See application file for complete search history.

(56) References Cited

U.S. PATENT DOCUMENTS

| | | | | |
|---|---|---|---|---|
| 5,089,849 | A * | 2/1992 | Hiraoka | G03G 21/1821 399/119 |
| 11,106,175 | B1 * | 8/2021 | Tanaka | G03G 21/1647 |
| 2006/0051131 | A1 * | 3/2006 | Takigawa | G03G 21/1864 399/159 |
| 2018/0267426 | A1 * | 9/2018 | Kusukawa | G03G 21/1676 |
| 2022/0404760 | A1 * | 12/2022 | Son | G03G 21/1676 |

FOREIGN PATENT DOCUMENTS

JP 2013-171068 A 9/2013

* cited by examiner

*Primary Examiner* — Sophia S Chen
(74) *Attorney, Agent, or Firm* — Studebaker & Brackett PC

(57) ABSTRACT

An image forming apparatus includes a photosensitive drum, a photoreceptor housing, a developing roller, a development housing, first contact members and second contact members. The first contact members are provided in end portions of the photoreceptor housing in an axial direction of the photosensitive drum. The second contact members are provided in end portions of the development housing in the axial direction, and come into contact with the first contact members by a force in which the development housing is pushed toward the photoreceptor housing. A position of at least one of the first contact member and the second contact member which come contact with each other can be adjusted in a direction in which the first contact member and the second contact member come close to each other or separate away from each other.

11 Claims, 9 Drawing Sheets

IMAGE FORMING APPARATUS AND ADJUSTMENT METHOD

INCORPORATION BY REFERENCE

This application is based on and claims the benefit of priority from Japanese patent application No. 2021-128336 filed on Aug. 4, 2021, which is incorporated by reference in its entirety.

BACKGROUND

The present disclosure relates to an image forming apparatus and an adjustment method.

In an electrophotographic type developing unit, gap regulating members having a radius slightly larger than a developing roller are conventionally provided at both axial end portions of the developing roller, and the gap regulating members are brought into contact with a photosensitive drum to form a predetermined gap between the outer circumferential surface of the developing roller and the outer circumferential surface of the photosensitive drum. However, in such a configuration, depending on an effect of the accumulation of tolerance for each member, an error may occur in the gap. Further, the rotating of the developing roller and the photosensitive drum may be uneven, and the image quality may fluctuate.

Therefore, a technique for adjusting the gap between the developing roller and the photosensitive drum has been discussed. For example, there is an electrophotographic apparatus including: an inter-axis distance adjusting means for adjusting the inter-axis distance so that the developer carrier is positioned at an adjustment position relatively displaced in the contact/separation direction with respect to the photosensitive member; a locking means for locking the developer carrier at a plurality of the adjustment positions in the contact/separation direction; and a fixing means for fixing the developer carrier at the adjustment position adjusted by the inter-axis distance adjusting means. The inter-axis distance adjusting means is provided with an eccentric cam whose rotational axis is displaced with respect to the rotational axis of the developer carrier, and a positioning part which is provided on the eccentric cam and positions the developer carrier, and the locking means is provided with an engagement part provided on the eccentric cam and having a large number of uneven portions along the rotational direction around the rotational axis of the eccentric cam, and a locking part having a locking claw for locking the uneven portions.

However, in the above configuration, since the eccentric cam is provided only at one end portion in the axial direction, it is difficult to make the distance between the photosensitive member and the developing roller even in the axial direction. Further, since the end portion of the shaft of the developing roller is fitted into the concave portion of the eccentric cam, the vibration caused by the rotating of the developing roller is transmitted to the photosensitive member via the eccentric cam, and the image quality may fluctuate.

SUMMARY

In accordance with one aspect of the present disclosure, an image forming apparatus includes a photosensitive drum, a photoreceptor housing, a developing roller, a development housing, first contact members and second contact members. The photosensitive drum carries an electrostatic latent image. The photoreceptor housing holds the photosensitive drum. The developing roller carries a developer. The development housing holds the developing roller such that an outer circumferential surface of the developing roller faces an outer circumferential surface of the photosensitive drum, and is rocked such that the developing roller comes close to the photosensitive drum and separates away from the photosensitive drum. The first contact members are provided in end portions of the photoreceptor housing in an axial direction of the photosensitive drum. The second contact members are provided in end portions of the development housing in the axial direction, and come into contact with the first contact members by a force in which the development housing is pushed toward the photoreceptor housing. A position of at least one of the first contact member and the second contact member can be adjusted in a direction in which the first contact member and the second contact member come close to each other or separate away from each other.

In accordance with one aspect of the present disclosure, an image forming apparatus includes a process for adjusting the position of the first contact member such that the photosensitive drum and the developing roller are separated away by a predetermined distance, using a master developing unit including the developing roller, the development housing, and the second contact member whose position is adjusted in advance; and a process for adjusting the position of the second contact member such that the photosensitive drum and the developing roller are separated away by the predetermined distance using a master photoreceptor unit including the photosensitive drum, the photoreceptor housing, and the first contact member whose position is adjusted in advance.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus 100 according to one embodiment of the present disclosure will be described.

Figure 1:
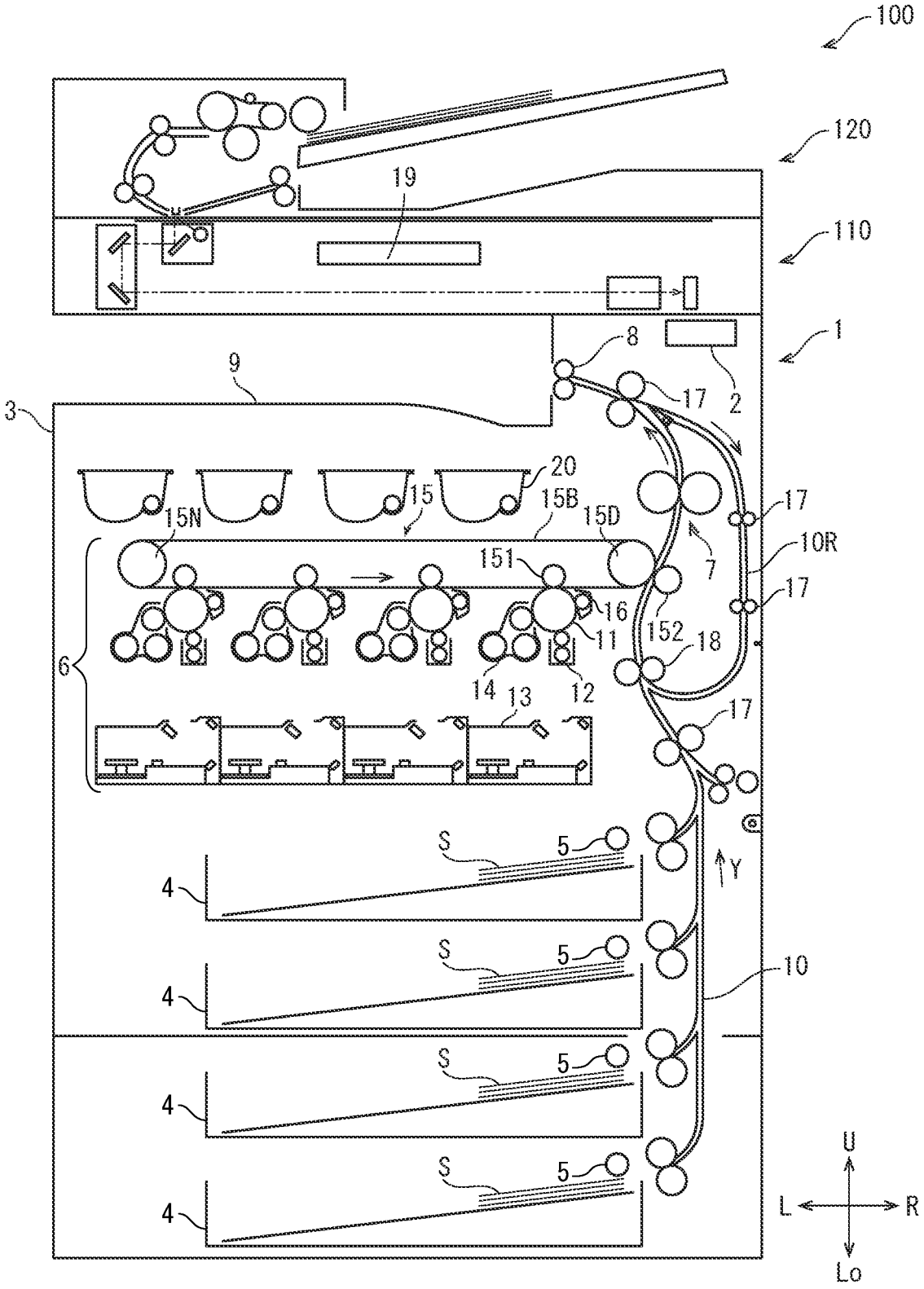
FIG. 1 is a front view schematically showing an inner structure of an image forming apparatus according to one embodiment of the present disclosure.

First, the entire structure of the image forming apparatus 100 will be described. FIG. 1 is a front view schematically showing an inner structure of the image forming apparatus 100. Hereinafter, the front side of the sheet surface on which FIG. 1 is drawn will be referred to as the front side of the image forming apparatus 100, and the left-and-right direction will be described with reference to the direction in which the image forming apparatus 100 is viewed from the front side. In each of the drawings, U, Lo, L, R, Fr and Rr indicate an upper, a lower, a left, a right, a front, and a rear, respectively.

The image forming apparatus 100 includes a printer 1, a scanner 110 and a document conveying device 120. The scanner 110 is provided above the printer 1, and the document conveying device 120 is provided above the scanner 110. The document conveying device 120 conveys a document along a conveyance path passing through a reading position of the scanner 110. The scanner 110 is a flatbed type image scanner, and reads the document to generate image data. The printer 1 forms an image on a sheet S based on the image data.

The printer 1 includes a parallelepiped main body housing 3. In the lower portion of the inside of the main body housing 3, a sheet feeding cassette 4 in which the sheet S is stored and a sheet feeding roller 5 which feeds the sheet S rightward from the sheet feeding cassette 4 are provided. Above the sheet feeding cassette 4, an image forming device 6 which forms a toner image by an electrophotographic method is provided. On the upper and right side of the image forming device 6, a fixing device 7 which fixes the toner image to the sheet S is provided. Above the fixing device 7, a sheet discharge roller 8 which discharges the sheet S on which the toner image is fixed and a sheet discharge tray 9 on which the discharged sheet S is stacked are provided.

Inside the main body housing 3, a conveyance path 10 is provided from the sheet feeding roller 5 to the sheet discharge roller 8 via the image forming device 6 and the fixing device 7. The conveyance path 10 is formed by plate-like members facing each other with a gap through which the sheet S is passed, and a conveying roller 17 which holds and conveys the sheet S is provided at a plurality of positions on the conveyance direction Y. A registration roller 18 is provided on the upstream side of the image forming device 6 in the conveyance direction Y. On the right side of the fixing device 7, an inversion conveyance path 10R branching from the conveyance path 10 on the downstream side of the fixing device 7 in the conveyance direction Y and merging with the conveyance path 10 on the upstream side of the registration roller 18 in the conveyance direction Y is provided.

The image forming device 6 includes a photosensitive drum 11 whose potential is changed by irradiation with light, a charging device 12 which charges the photosensitive drum 11, an exposure device 13 which emits laser light according to the image data, a developing unit 14 which supplies a toner to the photosensitive drum 11, an intermediate transfer unit 15 which transfers the toner image from the photosensitive drum 11 to the sheet S, and a cleaning device 16 which removes the toner remaining on the photosensitive drum 11. The intermediate transfer unit 15 includes an endless intermediate transfer belt 15B stretched around a driving roller 15D and a driven roller 15N, primary transfer rollers 151 which face the inner circumference surface of the intermediate transfer belt 15B at positions corresponding to the photosensitive drums 11 and generate a primary transfer bias, and a secondary transfer roller 152 which faces the outer circumference surface of the intermediate transfer belt 15B at a position corresponding to the driving roller 15D and generates a secondary transfer bias. Toner containers 20 which supply the toner to the developing units 14 are connected to the developing units 14.

The image forming device 6 includes four sets of the photosensitive drum 11, the charging device 12, the exposure device 13, the developing unit 14, the primary transfer roller 151, the cleaning device 16, and the toner container 20, and forms a color image by overlapping the toner images of four colors on an intermediate transfer belt 15B. The present disclosure may be applied to an image forming apparatus that forms a color image with toners of three or less colors, or five or more colors.

A controller 2 includes an arithmetic part and a storage part. The arithmetic part is a CPU (Central Processing Unit), for example. The storage part includes a storage medium such as ROM (Read Only Memory), RAM (Random Access Memory) and EEPROM (Electrically Erasable Programmable Read Only Memory). The arithmetic part reads, executes the control program stored in the storage part, and performs various processing. The controller 2 may be implemented by an integrated circuit without using software.

An operation panel 19 is provided on the front side of the scanner 110. The operation panel 19 includes a display panel, a touch panel overlapped on the display surface of the display panel, and a keypad adjacent to the display panel. The controller 2 displays a screen indicating an operation menu, a status and the others of the printer 1 and the scanner 110 on the display panel, and controls each part of the printer 1 and the scanner 110 according to an operation detected by the touch panel and the keypad.

The basic image forming operation of the printer 1 is as follows. When a single-side printing job is input to the printer 1 from an external computer or the like, the sheet feeding roller 5 feeds the sheet S from the sheet feeding cassette 4 to the conveyance path 10, the registration roller 18 whose rotation is stopped corrects the skew of the sheet S, and the registration roller 18 feeds the sheet S to the image forming device 6 at a predetermined timing. In the image forming device 6, the charging device 12 charges the photosensitive drum 11 to a predetermined potential, the exposure device 13 writes an electrostatic latent image on the photosensitive drum 11, the developing unit 14 develops the electrostatic latent image by using the toner supplied from the toner container 20 to form a toner image, the primary transfer roller 151 transfers the toner image to the intermediate transfer belt 15B, and the secondary transfer roller 152 transfers the toner image to the sheet S. Subsequently, the fixing device 7 melts the toner image and fixes it to the sheet S while holding and conveying the sheet S, and the sheet discharge roller 8 discharges the sheet S to the sheet discharge tray 9. The cleaning device 16 removes the toner remaining on the photosensitive drum 11. In the case of double-side printing, the sheet S having the toner image fixed on one surface of the sheet S is fed to the conveyance path 10 via the inversion conveyance path 10R, whereby the toner image is transferred to the other surface of the sheet S.

Figure 2:
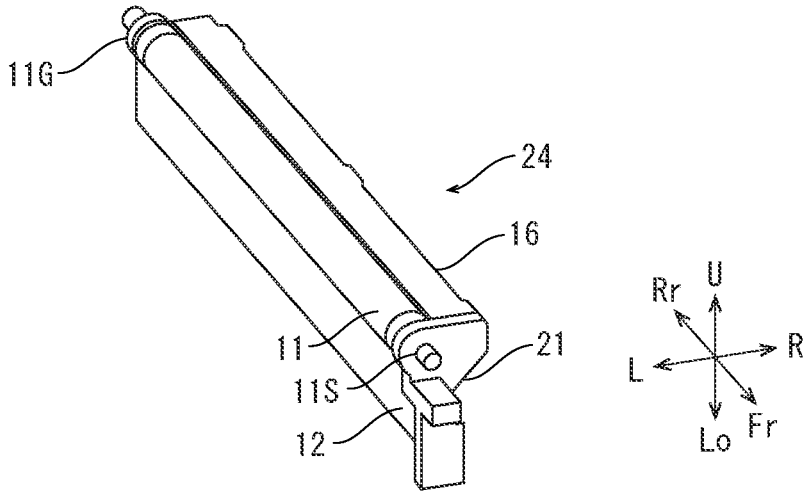
FIG. 2 is a perspective view showing a photoreceptor unit according to the embodiment of the present disclosure.
Figure 3:
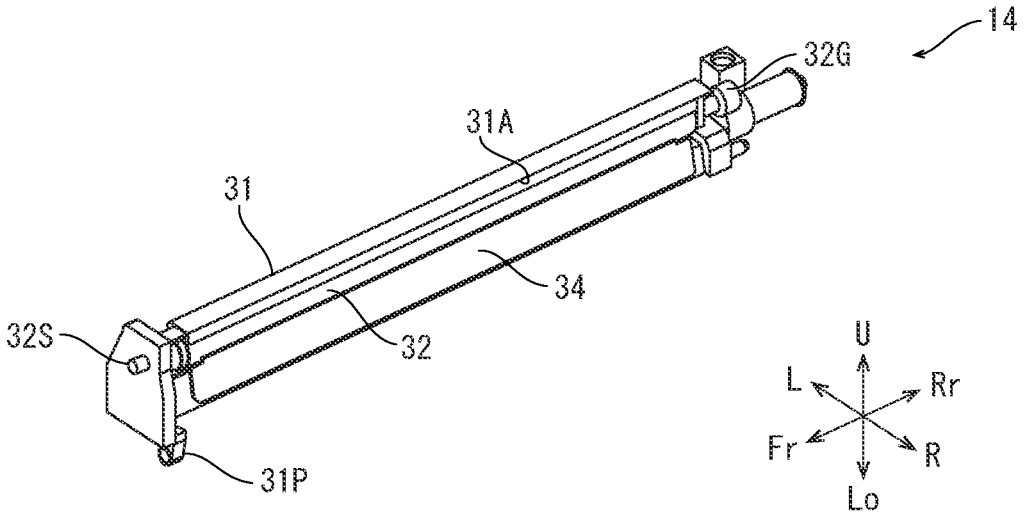
FIG. 3 is a perspective view showing a developing unit according to the embodiment of the present disclosure.
Figure 4:
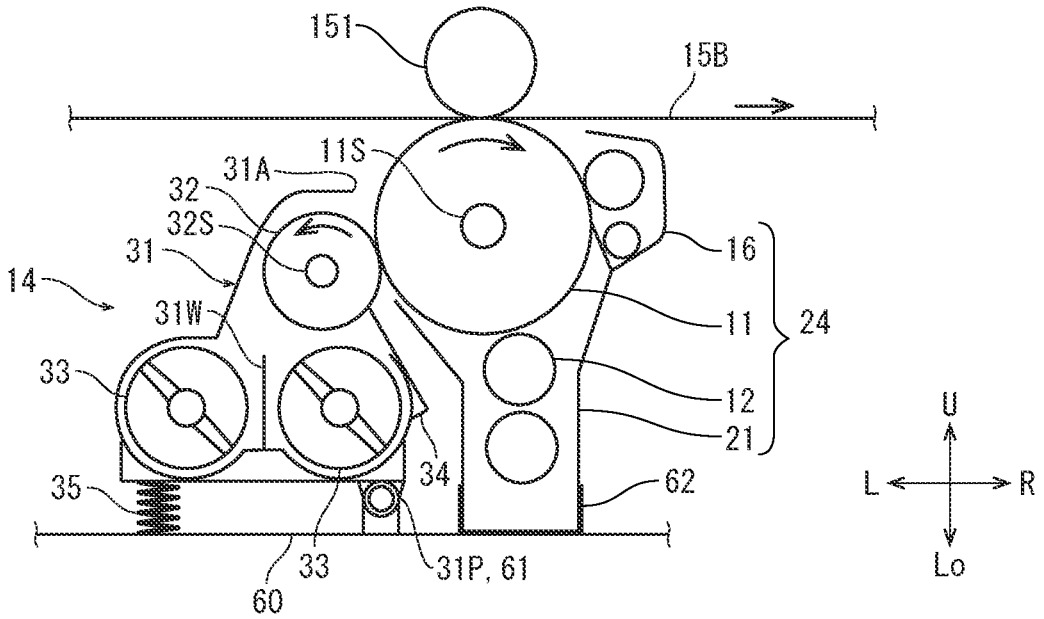
FIG. 4 is a front view schematically showing inner structures of the photoreceptor unit and the developing unit according to the embodiment of the present disclosure.
Figure 5:
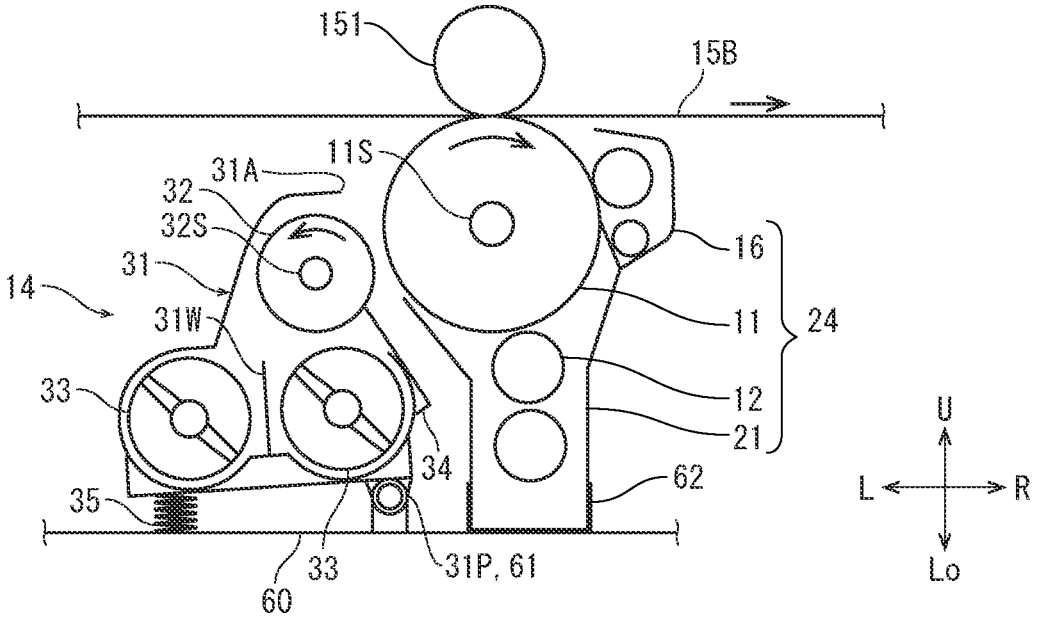
FIG. 5 is a front view schematically showing inner structures of the photoreceptor unit and the developing unit according to the embodiment of the present disclosure.

Next, the photoreceptor unit 24 and the developing unit 14 will be described. FIG. 2 is a perspective view showing the photoreceptor unit 24. FIG. 3 is a perspective view showing the developing unit 14. FIG. 4 and FIG. 5 are front views schematically showing internal structures of the photoreceptor unit 24 and the developing unit 14.

[Photoreceptor Unit] The photoreceptor unit 24 is configured by housing the photosensitive drum 11, the charging device 12, and the cleaning device 16 in a photoreceptor housing 21 and integrating them. The lower portion of the photoreceptor housing 21 is formed in a box shape whose longitudinal direction is along the front-and-rear direction, and the charging device 12 is housed therein. The main body housing 3 is provided with a support frame 60. The support frame 60 has a photoreceptor housing support part 62 into which the lower portion of the photoreceptor housing 21 is fitted. Above the charging device 12, the photosensitive drum 11 is provided, and on the right side of the photosensitive drum 11, the cleaning device 16 is provided. The shaft 11S of the photosensitive drum 11 is supported by bearings (not shown) provided at the front and rear end portions of the photoreceptor housing 21, and protrudes from the outer surfaces of the front and rear end portions of the photoreceptor housing 21. A driven gear 11G is provided at the rear end portion of the shaft 11S of the photosensitive drum 11.

[Developing Unit] The developing unit 14 includes two screws 33, a developing roller 32, a development housing 31, and a blade 34. The two screws 33 rotate around axes to agitate a developer. The developing roller 32 holds the developer above the screws 33. The development housing 31 stores the screws 33 and the developing roller 32, and has an opening 31A through which a part of the outer circumferential surface of the developing roller 32 is exposed. The blade 34 is disposed below the opening 31A, and regulates the layer thickness of the developer held by the developing roller 32. The developing roller 32 and the screws 33 are disposed with their axial direction along the front-and-rear direction.

The developer is a two-component developer containing a magnetic carrier and a non-magnetic toner, for example. The two screws 33 are disposed inside the development housing 31 in parallel with each other in the left-and-right direction, and convey the developer in opposite directions. A partition wall portion 31W is provided between the two screws 33. Gaps are provided between the front end of the partition wall portion 31W and the inner surface of the development housing 31, and between the rear end of the partition wall portion 31W and the inner surface of the development housing 31, and the developer circulates around the partition wall portion 31W through the gaps. The toner is agitated by the screws 33 to be triboelectrically charged.

The developing roller 32 is disposed in parallel above the right screw 33. The developing roller 32 includes a permanent magnet and a development sleeve made of non-magnetic material covering the outer circumference of the permanent magnet (not shown). The shaft 32S of the developing roller 32 is supported by bearings (not shown) provided at the front and rear end portions of the development housing 31, and protrude from the outer surfaces of the front and rear end portions of the development housing 31. A driven gear 32G is provided at the rear end portion of the shaft 32S of the developing roller 32. The opening 31A is formed on the right side portion of the upper portion of the development housing 31, and the outer circumferential surface of the developing roller 32 exposed through the opening 31A faces the outer circumferential surface of the photosensitive drum 11. The developer forms a magnetic brush layer on the surface of the developing roller 32. The tip of the blade 34 is disposed at a predetermined interval from the developing roller 32, and adjusts the layer thickness of the magnetic brush to a predetermined thickness.

The support frame 60 is provided with fulcrums 61 which support the front and rear portions of the lower portion of the development housing 31 on the side of the photoreceptor unit 24. A fulcrum connection part 31P connected to the fulcrum 61 is provided at the lower portion of the development housing 31. The fulcrums 61 and the fulcrum connection part 31P function as a rotational fulcrum whose axial direction is along the front-and-rear direction, and the development housing 31 can be rocked around the fulcrums 61. A biasing member 35 is provided on the left side of the fulcrums 61. The biasing member 35 is a compression coil spring inserted between the support frame 60 and the development housing 31, for example, and biases the development housing 31 toward the photoreceptor housing 21.

Figure 6:
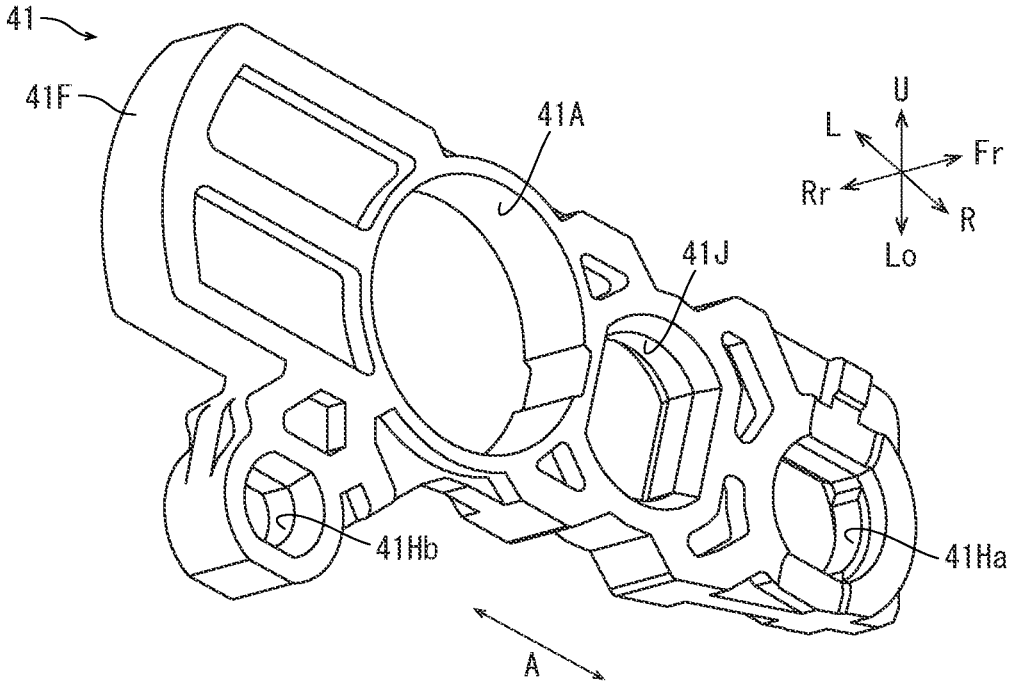
FIG. 6 is a perspective view showing a first contact member according to the embodiment of the present disclosure.

FIG. 5 and FIG. 6 show a state where the development housing 31 is rocked. FIG. 5 shows a state where the developing roller 32 is closest to the photosensitive drum 11, that is, the developing roller 32 is in contact with the photosensitive drum 11, in a case in which no force to resist the biasing by the biasing member 35 is applied. FIG. 6 shows a state in which the development housing 31 is pushed back in the counterclockwise direction against the biasing of the biasing member 35, and the developing roller 32 is separated away from the photosensitive drum 11.

Figure 7:
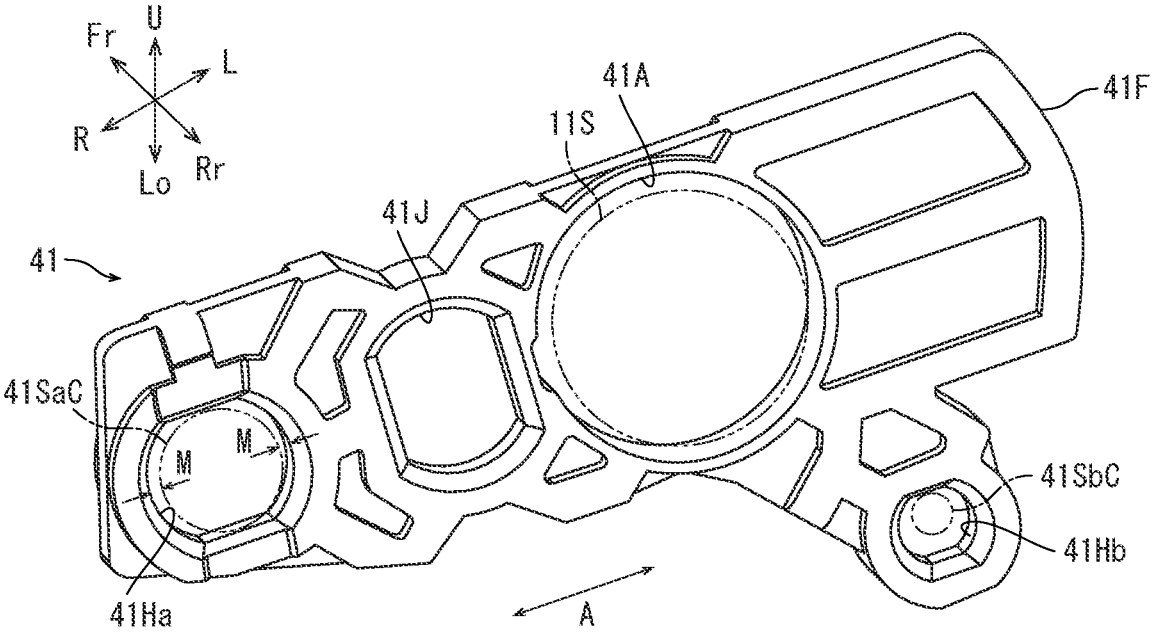
FIG. 7 is a perspective view showing the first contact member according to the embodiment of the present disclosure.
Figure 8:
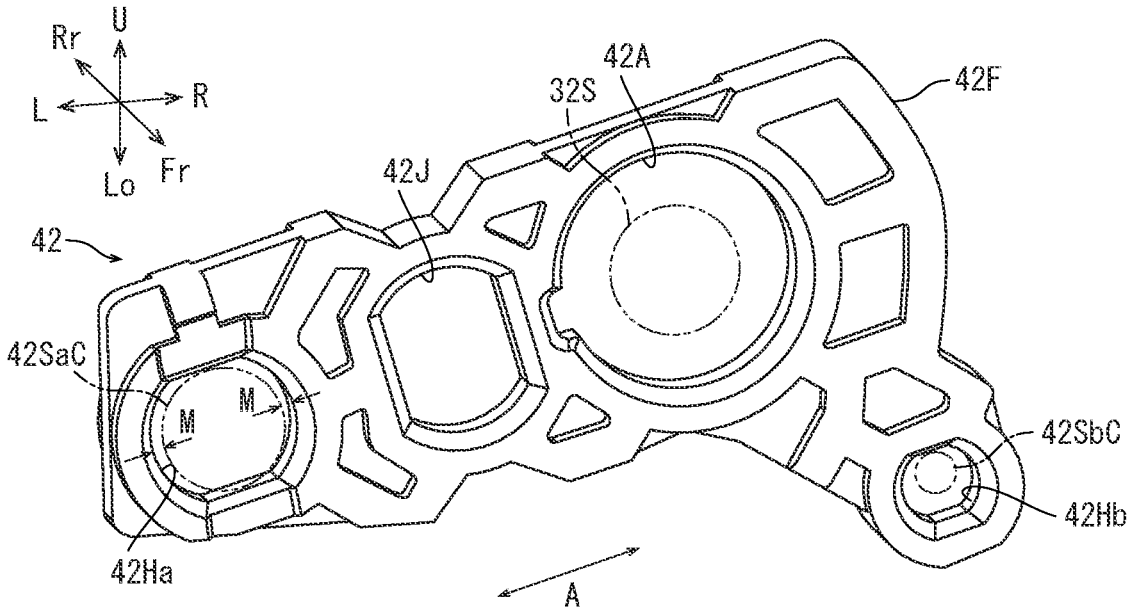
FIG. 8 is a perspective view showing a second contact member according to the embodiment of the present disclosure.
Figure 9:
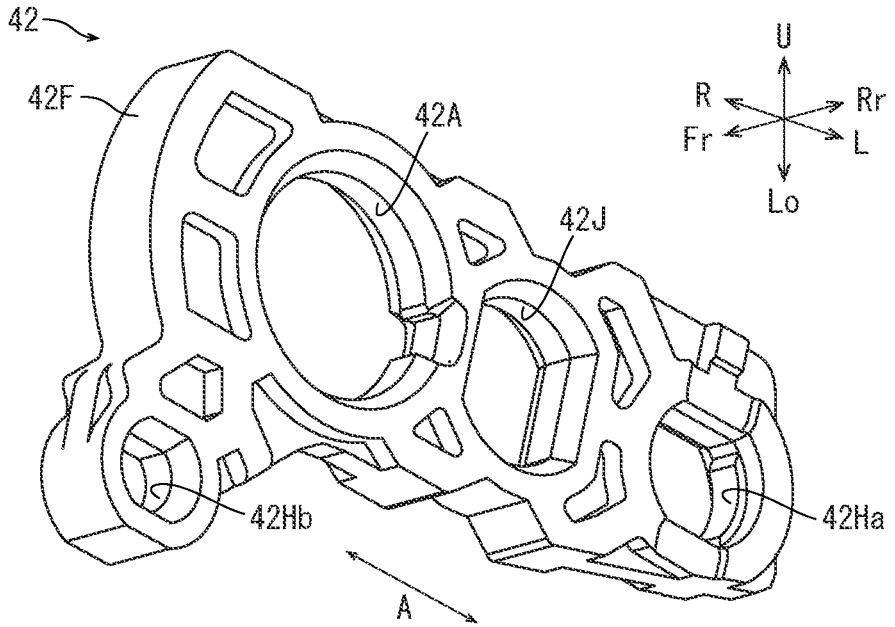
FIG. 9 is a perspective view showing the second contact member according to the embodiment of the present disclosure.
Figure 10:
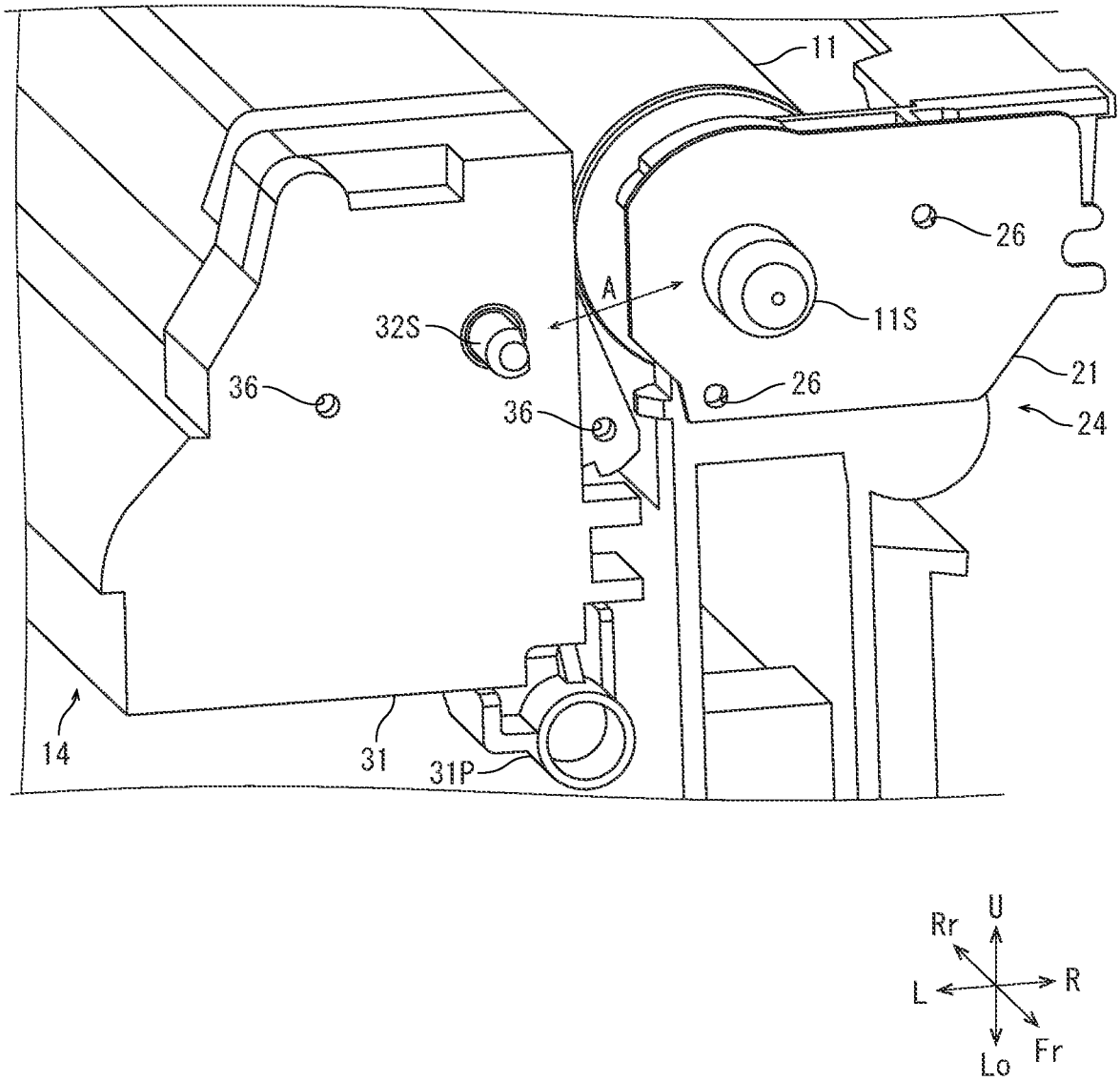
FIG. 10 is a perspective view showing the front portions of the photoreceptor unit and the developing unit attached to a main body housing according to the embodiment of the present disclosure.
Figure 11:
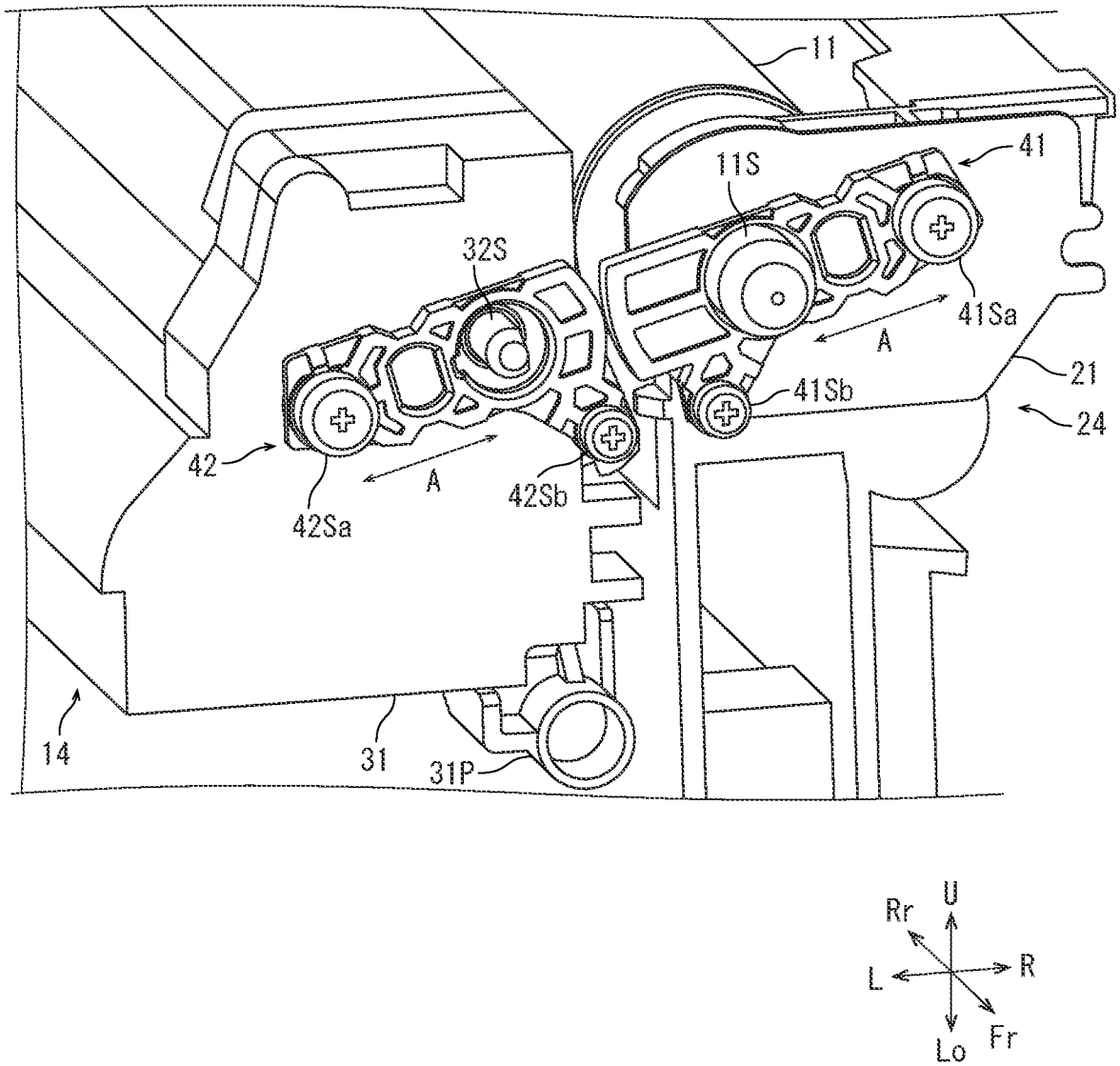
FIG. 11 is a perspective view showing the first contact member and the second contact member attached on the front portions of the photoreceptor unit and the developing unit according to the embodiment of the present disclosure.
Figure 12:
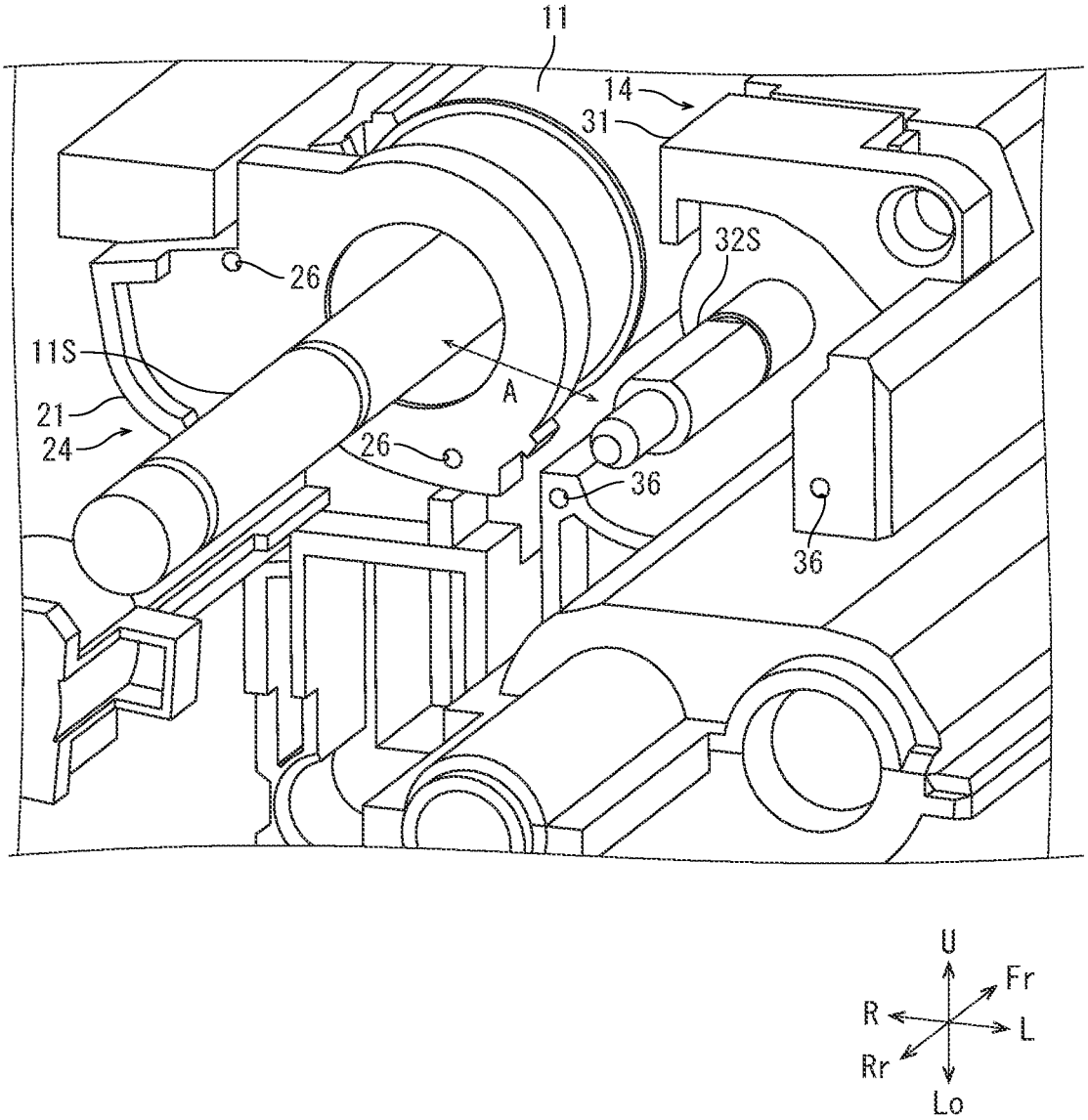
FIG. 12 is a perspective view showing the rear portions of the photoreceptor unit and the developing unit attached to the main body housing according to the embodiment of the present disclosure.
Figure 13:
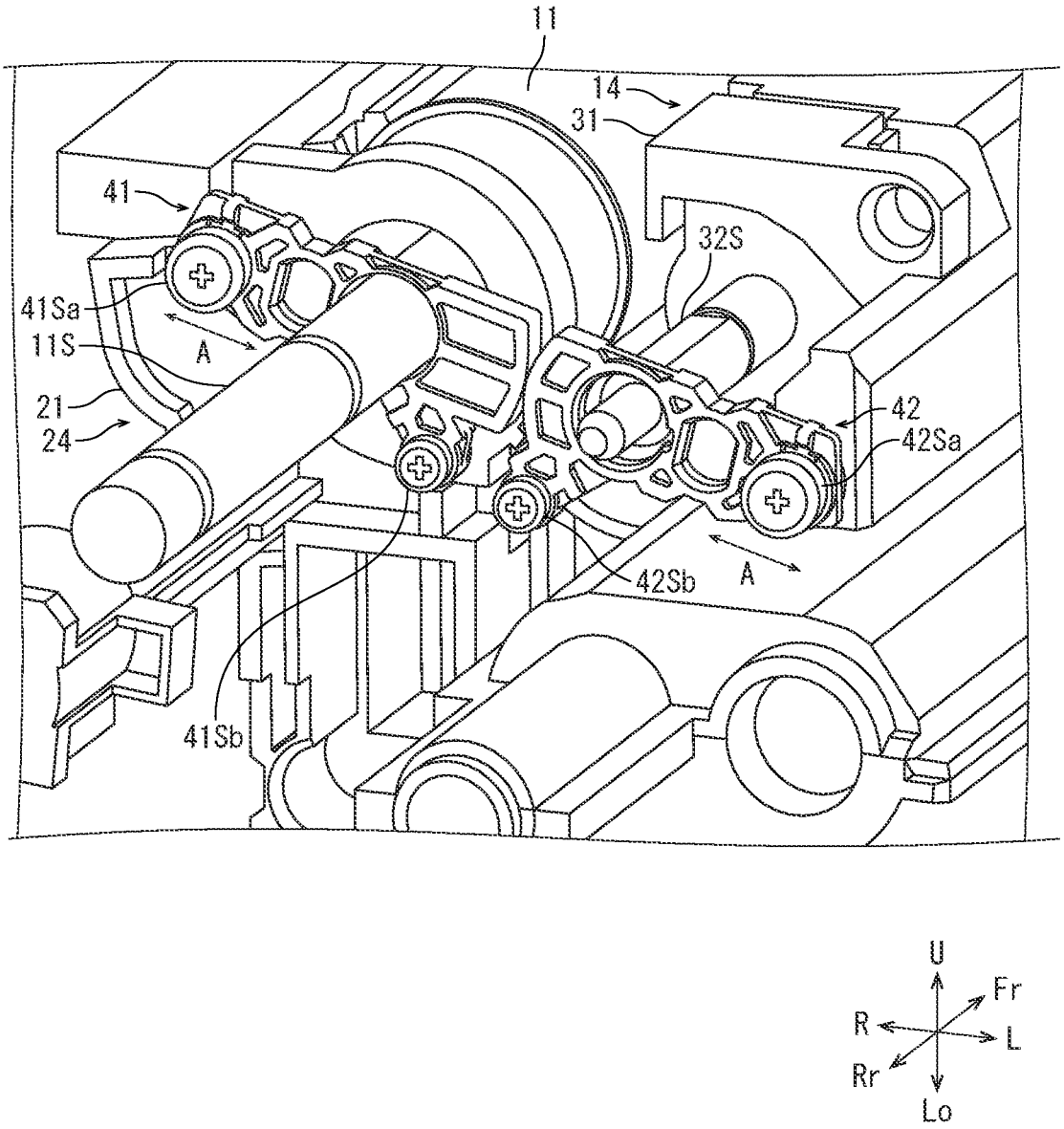
FIG. 13 is a perspective view showing the first contact member and the second contact member attached on the rear portions of the photoreceptor unit and the developing unit according to the embodiment of the present disclosure.

Next, a configuration for adjusting the gap between the photosensitive drum 11 and the developing roller 32 will be described. FIG. 6 and FIG. 7 are perspective views showing a first contact member 41. FIG. 8 and FIG. 9 are perspective views showing a second contact member 42. FIG. 10 is a perspective view showing the front portions of the photoreceptor unit 24 and the developing unit 14 attached to the main body housing 3. FIG. 11 is a perspective view showing the first contact member 41 and the second contact member 42 which are attached to the front portions of the photoreceptor unit 24 and the developing unit 14. FIG. 12 is a perspective view showing the rear portions of the photoreceptor unit 24 and the developing unit 14 attached to the main body housing 3. FIG. 13 is a perspective view showing the first contact member 41 and the second contact member 42 which are attached to the rear portions of the photoreceptor unit 24 and the developing unit 14.

The image forming apparatus 100 includes: the photosensitive drum 11 on which an electrostatic latent image is carried; the photoreceptor housing 21 which holds the photosensitive drum 11; the developing roller 32 on which the developer is carried; the development housing 31 which holds the developing roller 32 such that an outer circumferential surface of the developing roller 32 faces an outer circumferential surface of the photosensitive drum 11, and is rocked such that the developing roller 32 comes close to the photosensitive drum 11 and separates away from the photosensitive drum 11; the first contact members 41 provided in the end portions of the photoreceptor housing 21 in an axial direction of the photosensitive drum 11; and the second contact members 42 provided in the end portions of the development housing 31 in the axial direction, and come into contact with the first contact members 41 by a force in which the development housing 31 is pushed toward the photoreceptor housing 21, wherein the position of at least one of the first contact member 41 and the second contact member 42 can be adjusted in the direction in which the first contact member 41 and the second contact member 42 come close to each other or separate away from each other.

In the present embodiment, the elastic force generated by the above-described biasing member 35 is used as an example of a force that pushes the development housing 31 toward the photoreceptor housing 21, but an eccentric cam, a magnetic spring, or the like may be used instead of the biasing member 35, and a structure in which the development housing 31 is pushed toward the photoreceptor housing 21 by gravity may be used. Since the photosensitive drum 11, the photoreceptor housing 21, the developing roller 32, and the development housing 31 are described above, the first contact member 41 and the second contact member 42 will be mainly described below.

The first contact member 41 and the second contact member 42 are substantially rectangular plate-like members whose longitudinal direction is along a line crossing the shaft 11S of the photosensitive drum 11 and the shaft 32S of the developing roller 32. In the present embodiment, since the shaft 11S of the photosensitive drum 11 is positioned slightly above the shaft 32S of the developing roller 32, the line crossing the shaft 11S of the photosensitive drum 11 and the shaft 32S of the developing roller 32 is inclined such that a side (the right side) closer to the photosensitive drum 11 is higher. Therefore, the first contact member 41 and the second contact member 42 are also disposed so as to be inclined such that the right side portion of the horizontally long rectangle is higher. Hereinafter, the direction of the line crossing the shaft 11S of the photosensitive drum 11 and the shaft 32S of the developing roller 32 will be referred to as an adjustment direction A.

[First Contact Member] The left end portion of the first contact member 41 (see FIG. 6 and FIG. 7) has a first contact surface 41F where the center portion in the upper-and-lower direction expands leftward in an arc shape. On the right side of the first contact surface 41F, a first opening portion 41A, a first jig insertion portion 41J, and a first long hole portion 41Ha are formed in order from the left to the right. A first long hole portion 41Hb is formed on the portion protruded downward from between the first contact surface 41F and the first opening portion 41A. The first opening portion 41A is a substantially circular hole penetrating in the front-and-rear direction, and has a diameter larger than the shaft 11S of the photosensitive drum 11. The first jig insertion portion 41J is a hole penetrating in the front-and-rear direction. The first long hole portions 41Ha and 41Hb are long holes penetrating in the front-and-rear direction, and their longitudinal directions are along the adjustment direction A. In the present embodiment, the first long hole portion 41Ha is larger than the first long hole portion 41Hb, but the first long hole portion 41Ha and the first long hole portion 41Hb may be of any size.

Screw holes 26 corresponding to the first long hole portions 41Ha and 41Hb of the first contact member 41 are formed in the front and rear end portions of the photoreceptor housing 21 (see FIGS. 10 and 12). Both the end portions of the shaft 11S of the photosensitive drum 11 are inserted into the first opening portions 41A (see FIG. 11 and FIG. 13). The first contact member 41 is fixed to the photoreceptor housing 21 by screws 41Sa and 41Sb through the first long hole portions 41Ha and 41Hb.

The first long hole portion 41Ha (see FIG. 7) has arc-shaped curved surface portions facing each other in the left-and-right direction, and flat surface portions facing each other in the upper-and-lower direction. The flat surface portions are parallel to the adjustment direction A. The screw 41Sa (see FIG. 11 and FIG. 13) has a cylindrical portion 41SaC (a portion where a thread is not formed) between a head portion and a screw portion (a portion where a thread is formed). In FIG. 7, the outline of the outer circumferential surface of the cylindrical portion 41SaC is shown by a two-dot chain line. The diameter of the cylindrical portion 41SaC is equal to a distance between the upper and lower flat surface portions of the first long hole portion 41Ha. FIG. 7 shows a state in which the cylindrical portion 41SaC is located at the center of the first long hole portion 41Ha in the left-and-right direction, and the same amount of adjustment allowance M (margin) is provided on the right and left sides along the adjustment direction A. A gap wider than the adjustment allowance M is provided between the first opening portion 41A and the shaft 11S of the photosensitive drum 11 over the entire circumference.

Similarly, the first long hole portion 41Hb (see FIG. 7) has arc-shaped curved surface portions facing each other in the left-and-right direction, and flat surface portions facing each other in the upper-and-lower direction. The flat surface portions are parallel to the adjustment direction A. The screw 41Sa (see FIG. 11 and FIG. 13) has a cylindrical portion 41SbC between a head portion and a screw portion. In FIG. 7, the outline of the outer circumferential surface of the cylindrical portion 41SbC is shown by a two-dot chain line. The diameter of the cylindrical portion 41SbC is smaller than a distance between the upper and lower flat surface portions of the first long hole portion 41Hb, and the upper frat surface portion is in contact with the cylindrical portion 41Sbc. Gaps equal to and larger than the adjustment allowance M are provided between the cylindrical portion 41SbC and the left and right curved surfaces.

[Second Contact Member] The second contact member 42 has substantially the same shape as the first contact member 41. The right end portion of the second contact member 42 (see FIG. 8 and FIG. 9) has a second contact surface 42F where the center portion in the upper-and-lower direction expands rightward in an arc shape. On the right side of the second contact surface 42F, a second opening portion 42A, a second jig insertion portion 42J, and a second long hole portion 42Ha are formed in order from the right to the left. A distance between the second contact surface 42F and the second opening portion 42A is shorter than a distance between the first contact surface 41F and the first opening portion 41A. A second long hole portion 42Hb is formed on the portion protruded downward from between the second contact surface 42F and the second opening portion 42A. The second opening portion 42A is a substantially circular hole penetrating in the front-and-rear direction, and has a diameter larger than the shaft 32S of the developing roller 32. The second jig insertion portion 42J is a hole penetrating in the front-and-rear direction. The second long hole portions 42Ha and 42Hb are long holes penetrating in the front-and-rear direction, and their longitudinal directions are along the adjustment direction A. In the present embodiment, the second long hole portion 42Ha is larger than the second long hole portion 42Hb, but the second long hole portion 42Ha and the second long hole portion 42Hb may be of any size.

Screw holes 36 corresponding to the second long hole portions 42Ha and 42Hb of the second contact member 42 are formed in the front and rear end portions of the development housing 31 (see FIGS. 10 and 12). Both end portions of the shaft 32S of the developing roller 32 are inserted into the second opening portions 42A (see FIG. 11 and FIG. 13). The second contact member 42 is fixed to the development housing 31 by screws 42Sa and 42Sb through the second long hole portions 42Ha and 42Hb.

The second long hole portion 42Ha (see FIG. 8) has arc-shaped curved surface portions facing each other in the left-and-right direction, and flat surface portions facing each other in the upper-and-lower direction. The flat surface portions are parallel to the adjustment direction A. The screw 42Sa (see FIG. 11 and FIG. 13) has a cylindrical portion 42SaC between a head portion and a screw portion. The diameter of the cylindrical portion 42Sac is the same as a distance between the upper and lower flat surface portions of the second long hole portion 42Ha. FIG. 8 shows a state in which the cylindrical portion 42SaC is located at the center of the second long hole portion 42Ha in the left-and-right direction, and the same amount of adjustment allowance M (margin) is provided on the right and left sides along the adjustment direction A. A gap wider than the adjustment allowance M is provided between the second opening portion 42A and the shaft 32S of the developing roller 32 over the entire circumference.

Similarly, the second long hole portion 42Hb (see FIG. 8) has arc-shaped curved surface portions facing each other in the left-and-right direction, and flat surface portions facing each other in the upper-and-lower direction. The flat surface portions are parallel to the adjustment direction A. The screw 42Sb (see FIG. 11 and FIG. 13) has a cylindrical portion 42SbC between a head portion and a screw portion. The diameter of the cylindrical portion 42SbC is smaller than a distance between the upper and lower flat surface portions of the second long hole portion 42Hb, and the upper frat surface portion is in contact with the cylindrical portion 42Sbc. Gaps equal to and larger than the adjustment allowance M are provided between the cylindrical portion 42SbC and the left and right curved surfaces.

The screws 41Sa and 41Sb are loosened and temporarily tightened, and the first contact member 41 is moved along the adjustment direction A to adjust the position of the first contact member 41 with respect to the photoreceptor housing 21. Further, the screws 42Sa and 42Sb are loosened and temporarily tightened, and the second contact member 42 is moved along the adjustment direction A to adjust the position of the second contact member 42 with respect to the development housing 31.

In adjusting the positions of the first contact member 41 and the second contact member 42, the first contact member 41 and the second contact member 42 may be manually moved in the left-and-right direction, but for example, by inserting a jig capable of moving them for very short distance into the first jig insertion portion 41J and the second jig insertion portion 42J, high-precision adjustment can be easily performed.

With the above configuration, it becomes possible to adjust the distance between the photosensitive drum 11 and the developing roller 32, but in the actual adjustment operation, the position of the first contact member 41 (or the second contact member 42) is temporarily determined, and then the position of the second contact member 42 (or the first contact member 41) is adjusted so that the gap between the photosensitive drum 11 and the developing roller 32 is appropriate. However, since the photoreceptor unit 24 and the developing unit 14 are constituted by assembling a large number of parts, the adjustment through the temporary position determination may not adjust the gap appropriately due to accumulation of tolerances for each part. In this case, it is necessary to perform the temporary position determination again and then to adjust the position.

In order to avoid such complicated work, it is desirable to store in advance the photoreceptor unit 24 (a master photoreceptor unit) and the developing unit 14 (a master developing unit) in which the gap between the photosensitive drum 11 and the developing roller 32 is adjusted with high accuracy, and then to perform the adjustment based on these units. That is, the adjustment method according to the present embodiment includes a process for adjusting the position of the first contact member 41 such that the photosensitive drum 11 and the developing roller 32 are separated away by a predetermined distance, using the master developing unit including the developing roller 32, the development housing 31, and the second contact member 42 whose position is adjusted in advance; and a process for adjusting the position of the second contact member 42 such that the photosensitive drum 11 and the developing roller 32 are separated away by the predetermined distance using a master photoreceptor unit including the photosensitive drum 11, the photoreceptor housing 21, and the first contact member 41 whose position is adjusted in advance. Either of these two processes may be performed first.

The image forming apparatus 100 according to the embodiment described above includes: the photosensitive drum 11 on which an electrostatic latent image is carried; the photoreceptor housing 21 which holds the photosensitive drum 11; the developing roller 32 on which the developer is carried; the development housing 31 which holds the developing roller 32 such that an outer circumferential surface of the developing roller 32 faces an outer circumferential surface of the photosensitive drum 11, and is rocked such that the developing roller 32 comes close to the photosensitive drum 11 and separates away from the photosensitive drum 11; the first contact members 41 provided in the end portions of the photoreceptor housing 21 in an axial direction of the photosensitive drum 11; and the second contact members 42 provided in the end portions of the development housing 31 in the axial direction, and come into contact with the first contact members 41 by a force in which the development housing 31 is pushed toward the photoreceptor housing 21, wherein the position of at least one of the first contact member 41 and the second contact member 42 can be adjusted in the direction in which the first contact member 41 and the second contact member 42 come close to each other or separate away from each other. According to the configuration, since the first contact members 41 and the second contact members 42 are provided in the end portions in the axial direction, it becomes possible to make a gap between the photosensitive drum 11 and the developing roller 32 uniform in the axial direction.

In the image forming apparatus 100 according to the present embodiment, the first contact member 41 does not come into contact with the shaft 11S of the photosensitive drum 11, and the second contact member 42 does not come into contact with the shaft 32S of the developing roller 32. Therefore, it becomes possible to suppress the deterioration of image quality due to the vibration in association with the rotating of the photosensitive drum 11 and the developing roller 32.

In the image forming apparatus 100 according to the present embodiment, the positions of the first contact member 41 and the second contact member 42 can be adjusted on the straight line crossing the shaft 11S of the photosensitive drum 11 and the shaft 32S of the developing roller 32. According to the configuration, since a change amount of the gap between the first contact member 41 and the second contact member 42 is the same as a change amount of the gap between the photosensitive drum 11 and the developing roller 32, it becomes easy to adjust the gap.

In the image forming apparatus 100, both the end portions of the shaft 11S of the photosensitive drum 11 protrudes from the photoreceptor housing 21, the first contact member 41 includes: the plurality of first long hole portions 41Ha and 41Hb whose longitudinal direction is along the direction of the line crossing the shaft 11S of the photosensitive drum 11 and the shaft 32S of the developing roller 32; and the first opening portion 41A having a diameter larger than the end portions of the shaft 11S of the photosensitive drum 11, the first contact member 41 is fixed to the photoreceptor housing 21 by the screws 41Sa and 41Sb through the first long hole portions 41Ha and 41Hb, and the position of the first contact member 41 can be adjusted along the longitudinal direction of the first long hole portions 41Ha and 41Hb, and both the end portions of the shaft 11S of the photosensitive drum 11 are inserted into the first opening portions 41A and do not come into contact with the first opening portions 41A regardless of the position of the first contact member 41. Therefore, it becomes possible to suppress the deterioration of image quality due to the vibration.

In the image forming apparatus 100, both the end portions of the shaft 32S of the developing roller 32 protrudes from the development housing 31, the second contact member 42 includes: the plurality of second long hole portions 42Ha and 42Hb whose longitudinal direction is along the direction of the line crossing the shaft 11S of the photosensitive drum 11 and the shaft 32S of the developing roller 32; and the second opening portion 42A having a diameter larger than the end portions of the shaft 32S of the developing roller 32, the second contact member 42 is fixed to the development housing 31 by the screws 42Sa and 42Sb through the second long hole portions 42Ha and 42Hb, and the position of the second contact member 42 can be adjusted along the longitudinal direction of the second long hole portions 42Ha and 42Hb, and both the end portions of the shaft 32S of the developing roller 32 are inserted into the second opening portions 42A and do not come into contact with the second opening portions 42A regardless of the position of the second contact member 42. Therefore, it becomes possible to suppress the deterioration of image quality due to the vibration.

In the image forming apparatus 100 according to the present embodiment, the positions of the first contact member 41 and the second contact member 42 can be adjusted in the direction in which the first contact member 41 and the second contact member 42 come close to each other or separate away from each other. Therefore, it becomes possible to make the adjustment allowance between the photosensitive drum 11 and the developing roller 32 large.

The adjustment method according to the present embodiment includes: the process for adjusting the position of the first contact member 41 such that the photosensitive drum 11 and the developing roller 32 are separated away by a predetermined distance, using the master developing unit including the developing roller 32, the development housing 31, and the second contact member 42 whose position is adjusted in advance; and the process for adjusting the position of the second contact member 42 so that the photosensitive drum 11 and the developing roller 32 are separated away by the predetermined distance using the master photoreceptor unit including the photosensitive drum 11, the photoreceptor housing 21, and the first contact member 41 whose position is adjusted in advance. Therefore, compared with a case where the master developing unit and the master photoreceptor unit are not used, it becomes possible to adjust the gap easily with high precision.

The above embodiment may be modified as follows.

The above embodiment shows an example where the first contact member 41 and the second contact member 42 are fixed by the screws 41Sa or the like, but after they are fixed by the screw 41Sa, the first contact member 41 may be welded to the photoreceptor housing 21 and the second contact member 42 may be welded to the development housing 31. According to this configuration, it becomes possible to prevent the positions of the first contact member 41 and the second contact member 42 from being shifted.

The above embodiment shows an example where the first contact member 41 and the second contact member 42 have partially different shapes, but the first contact member 41 and the second contact member 42 may have the same shape. According to this configuration, the cost can be reduced.

The above embodiment shows an example where the shaft 11S of the photosensitive drum 11 is inserted into the first opening portion 41A, and the shaft 32S of the developing roller 32 is inserted into the second opening portion 42A, but the first contact member 41 may be provided above the shaft 11S of the photosensitive drum 11, and the second contact member 42 may be provided above the shaft 32S of the developing roller 32. Further, the first contact member 41 may be provided below the shaft 11S of the photosensitive drum 11, and the second contact member 42 may be provided below the shaft 32S of the developing roller 32. According to this configuration, it becomes possible to obtain an effect similar to that of the above-described embodiment.

The positions of the first long hole portions 41Ha and 41Hb and the first jig insertion portion 41J in the first contact member 41, and the positions of the second long hole portions 42Ha and 42Hb and the second jig insertion portion 42J in the second contact member 42 may be different from those of the above-described embodiment. According to this configuration, it becomes possible to obtain the same effect as those of the above-described embodiment.

The above embodiment shows an example in which the positions of both the first contact member 41 and the second contact member 42 can be adjusted, but the position of only one of the first contact member 41 and the second contact member 42 may be adjusted.

The invention claimed is:

1. An image forming apparatus comprising:

a photosensitive drum on which an electrostatic latent image is carried;

a photoreceptor housing which holds the photosensitive drum;

a developing roller on which a developer is carried;

a development housing which holds the developing roller such that an outer circumferential surface of the developing roller faces an outer circumferential surface of the photosensitive drum, and is rocked such that the developing roller comes close to the photosensitive drum and separates away from the photosensitive drum;

first contact members provided in end portions of the photoreceptor housing in an axial direction of the photosensitive drum; and second contact members provided in end portions of the development housing in the axial direction, and coming into contact with the first contact members by a force in which the development housing is pushed toward the photoreceptor housing, wherein a position of at least one of the first contact member and the second contact member which come into contact with each other can be adjusted in a direction in which the first contact member and the second contact member come close to each other or separate away from each other.

2. The image forming apparatus according to claim 1, wherein the first contact members do not come into contact with a shaft of the photosensitive drum, and the second contact members do not come into contact with a shaft of the developing roller.

3. The image forming apparatus according to claim 1, wherein positions of the first contact member and the second contact member which come into contact with each other can be adjusted on a straight line crossing a shaft of the photosensitive drum and a shaft of the developing roller.

4. The image forming apparatus according to claim 3, wherein both end portions of the shaft of the photosensitive drum protrude from the photoreceptor housing, each of the first contact members includes:

a plurality of first long hole portions whose longitudinal direction is along a direction of the line crossing the shaft of the photosensitive drum and the shaft of the developing roller; and a first opening portion having a diameter larger than the end portions of the shaft of the photosensitive drum, each of the first contact members is fixed to the photoreceptor housing by screws through the first long hole portions, and a position of each of the first contact members can be adjusted along the longitudinal direction of the first long hole portions, and each of the end portions of the shaft of the photosensitive drum is inserted into the first opening portion of each of the first contact members and does not come into contact with the first opening portion regardless of the position of each of the first contact members.

5. The image forming apparatus according to claim 4, wherein the plurality of first long hole portions are arranged on a side close to the developing roller and on a side far from the developing roller with respect to the first opening portion.

6. The image forming apparatus according to claim 3, wherein both end portions of the shaft of the developing roller protrude from the development housing, each of the second contact members includes:

a plurality of second long hole portions whose longitudinal direction is along a direction of the line crossing the shaft of the photosensitive drum and the shaft of the developing roller; and a second opening portion having a diameter larger than the end portions of the shaft of the developing roller, each of the second contact members is fixed to the development housing by screws through the second long hole portions, and a position of each of the second contact members can be adjusted along the longitudinal direction of the second long hole portions, and each of the end portions of the shaft of the developing roller is inserted into the second opening portion of each of the second contact members and does not come into contact with the second opening portion regardless of the position of each of the second contact members.

7. The image forming apparatus according to claim 6, wherein the plurality of second long hole portions are arranged on a side close to the photosensitive drum and on a side far from the photosensitive drum with respect to the second opening portion.

8. The image forming apparatus according to claim 1, wherein the positions of the first contact member and the second contact member which come into contact with each other can be adjusted in a direction in which the first contact member and the second contact member come close to each other or separate away from each other.

9. An adjustment method comprising:

a process for adjusting the position of each of the first contact members such that the photosensitive drum and the developing roller are separated away by a predetermined distance, using a master developing unit including the developing roller, the development housing, and the second contact member whose position is adjusted in advance according to claim 8; and a process for adjusting the position of each of the second contact members such that the photosensitive drum and the developing roller are separated away by the predetermined distance using a master photoreceptor unit including the photosensitive drum, the photoreceptor housing, and the first contact member whose position is adjusted in advance according to claim 8.

10. The method of adjustment according to claim 9, wherein a process for temporarily fixing each of the first contact members with a first screw and then welding the first contact member to the photoreceptor housing; and a process for temporarily fixing each of the second contact members with a second screw and then welding the second contact member to the development housing.

11. The image forming apparatus according to claim 1, wherein each of the first contact members has a first contact surface expanded in an arc shape, and each of the second contact members has a second contact surface which is expanded in an arc shape and capable of coming into contact with the first contact surface.

* * * * *